US009492762B2

(12) United States Patent
Albert et al.

(10) Patent No.: US 9,492,762 B2
(45) Date of Patent: Nov. 15, 2016

(54) SENSOR CONFIGURATION FOR TOY

(71) Applicant: Funfare, LLC, Redwood City, CA (US)

(72) Inventors: Charles Albert, Redwood City, CA (US); Joshua W. Garrett, San Francisco, CA (US); Jason G. Heller, San Mateo, CA (US)

(73) Assignee: Funfare, LLC, Redwood City, CA (US)

( * ) Notice: Subject to any disclaimer, the term of this patent is extended or adjusted under 35 U.S.C. 154(b) by 528 days.

(21) Appl. No.: 13/889,119

(22) Filed: May 7, 2013

(65) Prior Publication Data

US 2013/0303047 A1 Nov. 14, 2013

Related U.S. Application Data

(60) Provisional application No. 61/644,162, filed on May 8, 2012.

(51) Int. Cl.

| | |
|---|---|
| ***A63H 3/24*** | (2006.01) |
| ***A63H 33/00*** | (2006.01) |
| ***A63H 5/00*** | (2006.01) |
| *A63F 9/24* | (2006.01) |
| *A63F 3/00* | (2006.01) |

(52) U.S. Cl.

CPC ..... *A63H 33/00* (2013.01); *A63H 5/00* (2013.01); *A63F 3/00643* (2013.01); *A63F 2009/2444* (2013.01); *A63H 2200/00* (2013.01)

(58) Field of Classification Search

USPC ..... 446/175

See application file for complete search history.

(56) References Cited

U.S. PATENT DOCUMENTS

| | | | | |
|---|---|---|---|---|
| 4,701,681 | A | 10/1987 | Koike | |
| 4,729,563 | A | 3/1988 | Yokoi | |
| 4,874,343 | A | 10/1989 | Rosenthal | |
| 5,606,494 | A * | 2/1997 | Oshima | A63F 13/00 345/158 |
| 5,873,765 | A | 2/1999 | Rifkin et al. | |
| 6,200,188 | B1 | 3/2001 | Filo | |
| 6,761,634 | B1 | 7/2004 | Peterson et al. | |
| 6,814,643 | B1 | 11/2004 | Dooley et al. | |
| 6,965,298 | B2 | 11/2005 | Feinberg | |
| 7,059,933 | B1 * | 6/2006 | Hsiao et al. | 446/297 |
| 7,097,532 | B1 | 8/2006 | Rolicki et al. | |

(Continued)

FOREIGN PATENT DOCUMENTS

| | | | |
|---|---|---|---|
| JP | 2-172487 | 7/1990 | |
| JP | 10-33836 | 2/1998 | |
| WO | WO 01/15059 A2 * | 3/2001 | A63H 18/10 |

OTHER PUBLICATIONS

Mattel, "Loopz Game," Game description from Amazon.com, http://web.archive.org/web/20111220030048/http:/www.amazon.com/Mattel-T5118-Loopz-Game/dp/B0037BO8GQ , 7 pages, Dec. 22, 2011.

(Continued)

*Primary Examiner* — Tramar Harper
(74) *Attorney, Agent, or Firm* — Beyer Law Group LLP

(57) ABSTRACT

A variety of methods and arrangements for facilitating communication between an electronic device and a toy are described. In one aspect, the toy communicates with the electronic device using audio signals and/or conductive touch elements. Some embodiments involve an electronic device that is arranged to use light-based control signals to communicate with a toy. In various implementations, the toy includes a light/motion sensor that allows a user to interact with the toy.

21 Claims, 5 Drawing Sheets

(56) References Cited

U.S. PATENT DOCUMENTS

| | | | | |
|---|---|---|---|---|
| 7,744,441 | B2 | 6/2010 | Sosnovskiy | |
| 8,177,601 | B2 | 5/2012 | Ekstein-Lieberman | |
| 2006/0234602 | A1 | 10/2006 | Palmquist | |
| 2008/0004110 | A1* | 1/2008 | Cortenraad et al. | 463/34 |
| 2008/0058045 | A1* | 3/2008 | Cortenraad et al. | 463/9 |
| 2008/0161086 | A1* | 7/2008 | Decre et al. | 463/14 |
| 2008/0211183 | A1* | 9/2008 | Cortenraad et al. | 273/237 |
| 2009/0325456 | A1 | 12/2009 | Willett | |
| 2011/0227871 | A1 | 9/2011 | Cannon | |
| 2012/0050198 | A1 | 3/2012 | Cannon | |
| 2012/0194457 | A1* | 8/2012 | Cannon | A63F 13/02 345/173 |
| 2012/0212427 | A1 | 8/2012 | Li et al. | |
| 2013/0065482 | A1* | 3/2013 | Trickett | 446/397 |
| 2013/0123987 | A1* | 5/2013 | Kase et al. | 700/259 |
| 2013/0288560 | A1* | 10/2013 | Abou-Hamda | 446/175 |
| 2013/0310956 | A1* | 11/2013 | Rehkemper et al. | 700/83 |
| 2013/0324241 | A1* | 12/2013 | Elliott | 463/31 |
| 2014/0024287 | A1* | 1/2014 | Mineur et al. | 446/484 |
| 2014/0273717 | A1* | 9/2014 | Judkins et al. | 446/175 |

OTHER PUBLICATIONS

Discovery Bay Games, "Duo Plink" Product description from timetoplaymag.com; www.timetoplaymag.com/toys/3337/discovery-bay-games/duo-plink/ , 3 pages, Apr. 18, 2012.

* cited by examiner

SENSOR CONFIGURATION FOR TOY

RELATED APPLICATIONS

This application claims priority to U.S. Provisional Patent Application No. 61/644,162, entitled "Sensor Configuration for Toy," filed May 8, 2012, which is incorporated by reference herein in its entirety for all purposes.

FIELD OF THE INVENTION

The present invention relates generally to toys, toy playsets and electronic devices. More specifically, various embodiments of the present invention relate to toys that may receive data via a light or motion sensor and/or transmit data using an audio signal.

BACKGROUND

There are a wide variety of toys that utilize a light sensor. For example, some toys are able to react to a change in ambient light. Thus, covering a toy can cause a reaction that does not occur when the toy is exposed to light. In other toys, a light sensor is used to receive information. For example, some toy designs involve a toy that receives a series of pulsed light signals. The pulsed light sensors form a code that can be read by a light sensor on the toy. The code can then activate a feature of the toy, such as the playing of music.

Other toys communicate through the use of sound. For example, some toy designs involve transmitting an audio signal from one toy component to another. The sound may be inaudible to the human ear. To a child who is playing with the toy, it will seem as if the toy components are magically influencing and interacting with one another.

Although the above approaches work well for various applications, there are ongoing efforts to improve upon the way in which toys can communicate with one another and their external environment.

SUMMARY OF THE INVENTION

A variety of methods and arrangements for facilitating communication between an electronic device and a toy are described. In one aspect, the toy communicates with the electronic device using audio signals and/or conductive touch elements. Some embodiments involve an electronic device that is arranged to use light-based control signals to communicate with a toy. In various implementations, the toy includes a light/motion sensor that allows a user to interact with the toy.

The toy may have a wide variety of shapes and sizes. In some embodiments, for example, the toy resembles a musician, an alien, an animal, a monster, a vehicle, a machine, a human or any other suitable object. In various designs, the base of the toy rests on a surface of the electronic device. The light sensor is situated in the base and is arranged to face the underlying electronic device. Various implementations involve a toy with two ends, with the light detecting sensor at one end and the motion/ambient light detecting sensor at the other, opposing end. In some implementations, the toy communicates with the electronic device using the aforementioned audio and light signals and has neither an antenna for wireless communication nor a video display screen. The electronic device may be any suitable computing, toy or game device, including but not limited to a tablet computer with a touch sensitive or capacitive video display screen.

The electronic device and toy are arranged to communicate with one another using audio signals and/or light signals. In various embodiments, the use of different types of signals enables full duplex communication between the electronic device and the toy. Some designs, for example, involve an electronic device that uses a display screen to flash a sequence at a region of the screen that directly underlies the light sensor of a toy. The toy can respond to the electronic device by emitting inaudible audio signals from its speaker. The audio signals prompt the electronic device to respond in turn by displaying images on the screen, sending additional light-based control signals and/or by emitting sounds, such as music or a voice recording.

Some embodiments involve a toy that also communicates to an underlying electronic device using conductive touch elements. The conductive touch elements are detectable using a capacitive touch screen. From the relative spacing and/or arrangement of the one or more conductive touch elements, the electronic device can identify the toy and/or determine its location on the screen.

In various implementations, the electronic device includes a sensor that is arranged to detect ambient light or motion. As a result, a user who covers the toy or waves a physical object near the toy can trigger the sensor. In response, the toy can emit sounds or send a corresponding audio signal to the electronic device, so the electronic device recognizes the motion and responds in an appropriate manner.

In another aspect, the present invention contemplates a method for identifying and synchronizing multiple toys on an electronic device. By way of example, the electronic device may be a tablet computer with a video display screen or a toy platform or stage. Multiple toys are positioned at different locations on the screen. The electronic device searches for the presence of toys on its screen by flashing or sending light-based control signals to different locations on the screen at different times. When the light-based control signal is transmitted at a location that underlies one of the toys, the toy receives the signal through a bottom light sensor and responds by sending out an audio signal (e.g., an inaudible ultrasonic or subsonic signal.) The electronic device receives the audio signal and thereby identifies each toy and its distinct characteristics. The electronic device then synchronizes the operations of the multiple toys that are placed on the screen. In some approaches, the electronic device sends light-based control signals through the bottom light sensors in the toys so that the toys emit sounds (e.g., music, voices) that are coordinated or in time with another. In other approaches, the light-based control signals instruct the toys to emit audio signals only in such a way that the audio signals do not overlap or interfere with one another.

The present invention also contemplates a variety of other methods and mechanisms relating to communication between the electronic device, the toy and/or other components.

BRIEF DESCRIPTION OF THE DRAWINGS

The invention and the advantages thereof, may best be understood by reference to the following description taken in conjunction with the accompanying drawings in which.

In the drawings, like reference numerals are sometimes used to designate like structural elements. It should also be appreciated that the depictions in the figures are diagrammatic and not to scale.

DETAILED DESCRIPTION

The present invention relates generally to toys and electronic devices. More specifically, the present invention relates to toys that communicate with other components and their external environment using audio signals, light sensors and/or other mechanisms.

Figure 1A:
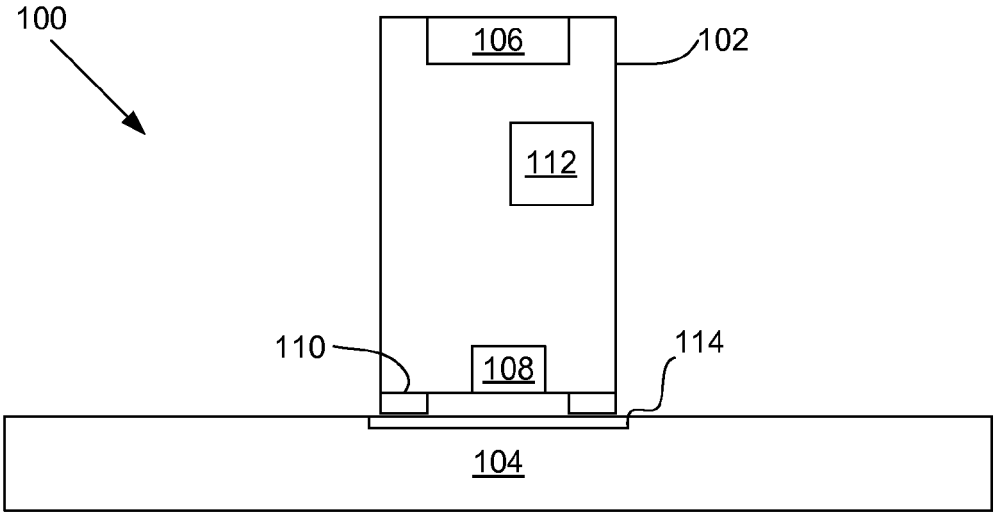
FIG. 1A is a side view of a toy and an electronic device according to a particular embodiment of the present invention.
Figure 1B:
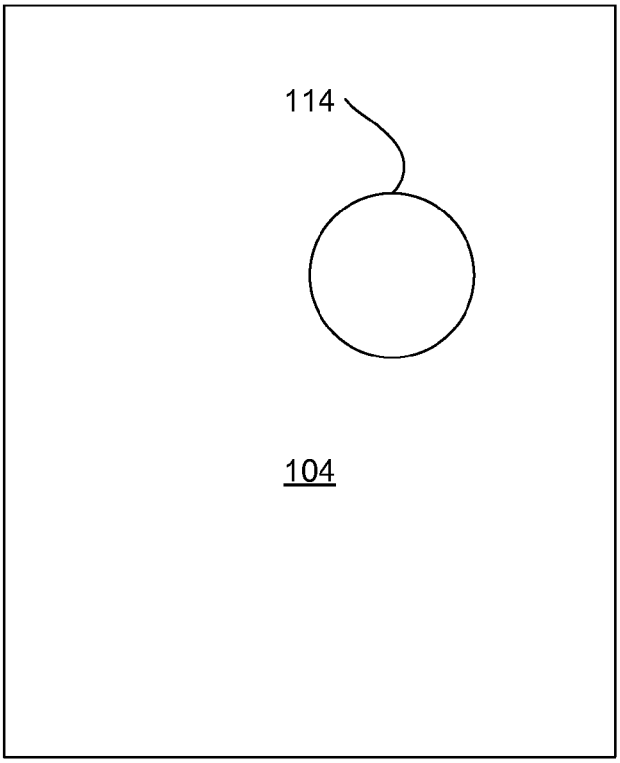
FIG. 1B is a top view of the toy and the electronic device of FIG. 1A.

FIGS. 1A and 1B illustrate side and top views of a toy arrangement 100 according to a particular embodiment of the present invention. The toy arrangement 100 includes a toy 102 that is positioned over an electronic device 104. The toy includes a top light/motion sensor 106, a bottom light sensor 108, multiple conductive touch elements 110 and a speaker 112. The conductive touch elements 108 are at the base of the toy and rest on a screen or light emitting portion of the electronic device 104. The electronic device 104 includes a microphone (not shown) and is arranged to generate light at a location 114 on its surface that directly underlies the toy. In the illustrated embodiment, the toy 102 and electronic device 104 are a toy figure and a tablet computer with a capacitive touch screen, although the present invention contemplates the use of a wide variety of other types of toys and electronic devices as well.

The combination of the speaker 112, conductive touch elements 110 and light sensors in the toy allow the toy 102 to interact in a wide variety of ways with the underlying electronic device 104. In particular, the toy 102 can emit audio signals through its speaker 112, which can be received and processed by the electronic device using its microphone. The electronic device 104 can respond by flashing light at the toy location 114 to generate a code, which can be read by the toy 102 using its bottom light sensor 108. Additionally, a child playing with the toy arrangement 100 can interact further with the toy 102 using the top light/motion sensor 106. The top light/motion sensor 106 senses motion and/or the level of ambient light. If the child covers the toy 102 or waves his or hand over the top light/motion sensor 106, the top light sensor 106 can detect this activity, which in turn triggers a response from the toy 102. The capacitive touch screen of the electronic device 104 can also detect the relative arrangement and/or spacing of the conductive touch elements 110 at the base of the toy, which allows the electronic device 104 to identify the toy 102 and its position on the screen. As a result, the electronic device can flash light signals at any location on its surface where the toy 102 is placed.

The above features offer a variety of advantages and play possibilities. The use of light and audio signals makes possible an asynchronous, full duplex communication system between the toy 102 and the electronic device 104. The top light/motion sensor 106 also allows a child to further interact with and control this communication. For example, in one implementation, the speaker 112 of the toy 102 emits a musical tune. The child can repeatedly wave his hand over the top light/motion sensor 106. The toy 102 can adjust the tune at each wave of the hand (e.g., adjust the pitch, add a chord, introduce a scratching-like effect, etc.). The toy 102 detects each wave and sends a corresponding (inaudible) audio signal through speaker 112 to the electronic device 104. The electronic device 104 may then display one or more images that correlate with each wave of the hand and that the child can interact with via a touch sensitive screen on the electronic device 104. These interactions can in turn be communicated to the toy 102 using a light-based signal from the electronic device 104 and the bottom light sensor 108. The toy can then make additional sounds or adjust aspects of the music. The child can further interact with the toy arrangement by moving the position of the toy 102 on the screen of the electronic device 104. The electronic device 104 can track the location of the toy through the conductive touch elements 110 at the base of the toy and respond using sound or images. In other words, the child, electronic device 104 and toy 102 can communicate with one another and trigger responses in one another simultaneously, which can create a wide variety of interesting and entertaining effects.

An additional advantage of the above approach is that it is relatively cost-effective. To provide such a high level of wireless interactivity, computing devices and toys often require more expensive components, such as an antenna, a wireless communication mechanism (e.g., Bluetooth, WiFi, etc.) or a video display screen. However, various implementations of the toy 104 lack any or all of these components and can support a robust communications system with a speaker, light sensors and/or conductive touch elements. These components are generally more affordable and less vulnerable to physical damage.

Figure 2:
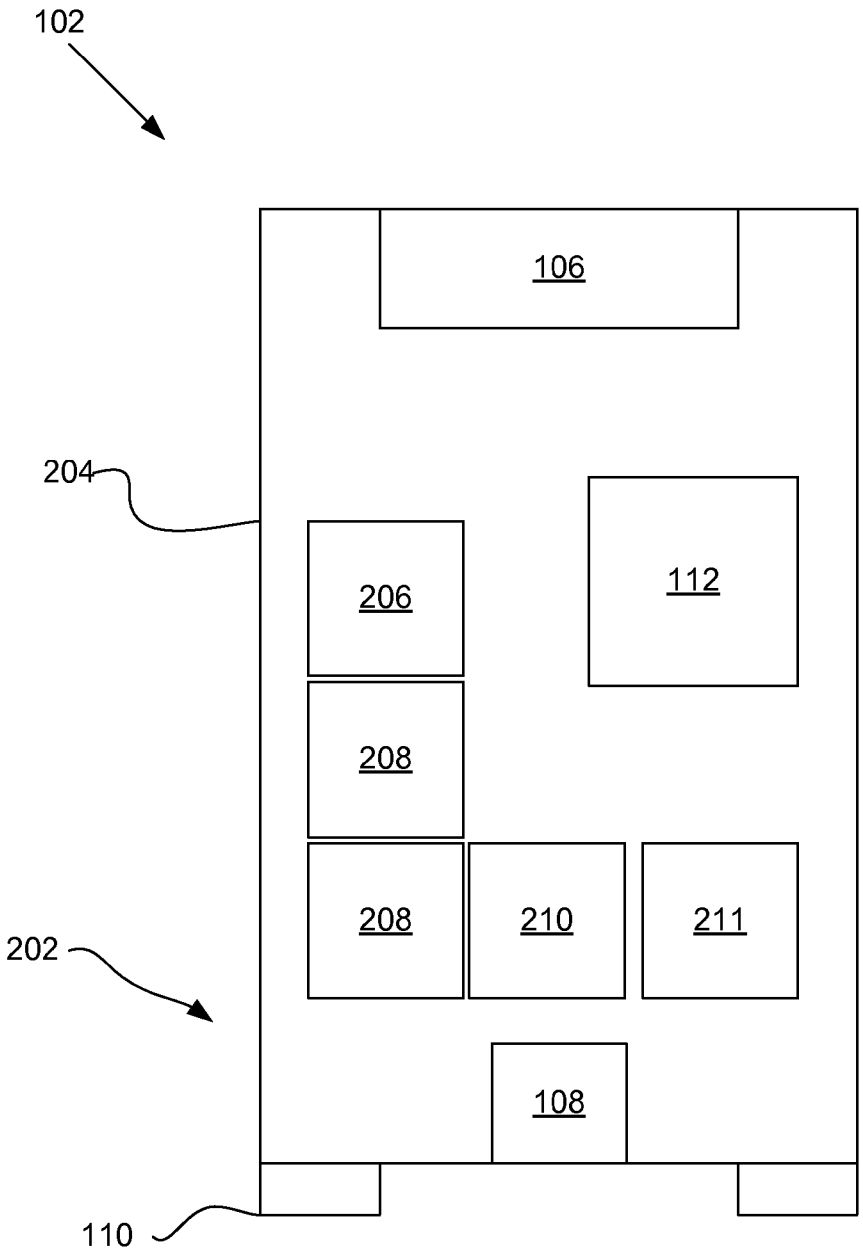
FIG. 2 is a diagram of a toy according to a particular embodiment of the present invention.

Referring next to FIG. 2, an enlarged view of the toy of FIG. 1A according to a particular embodiment of the present invention will be described. The toy includes a base 202 that physically supports a body 204. The base 202 includes a bottom light sensor 108, a top light/motion sensor 106 and one or more conductive elements 110. The toy 102 further includes a power supply 206, a speaker 112, a microphone 211, a processor 208 and a storage device 210.

The conductive elements 110 are arranged to rest on and interact with a touch sensitive screen, such as a capacitive screen of a tablet computer or other electronic device 104. The conductive elements typically form a particular type of geometric arrangement or pattern. By detecting and interpreting this pattern (e.g., assessing the distance between too different elements), the electronic device 104 can identify the toy 102. For example, if the toy 102 represents a particular type of character and there are multiple characters, the electronic device 104 can use the conductive touch elements 110 to determine which character is in contact with the screen and react with sound or images that are associated with that character. Additionally, the conductive touch elements 110 help the electronic device determine where the toy has been placed on the screen. As a result, appropriate images can be displayed on the screen around the toy, irrespective of where it is. Also, as previously discussed, if the electronic device recognizes where the toy location 114 is, it can communicate with the toy by flashing a light at the toy location 114. It should be appreciated that some toys have non-conductive pads or feet instead of the conductive elements. In still other embodiments, there are no pads and the base, bottom surface and/or bottom light sensor 108 of the toy comes in direct contact with the underlying surface or electronic device.

Such light-based control signals are received at the bottom light sensor 108 of the toy. The bottom sensor 108 is arranged to receive a light signal that forms a code. For example, the electronic device 104 can generate such a code by flashing a region of the screen that directly underlies the toy. The processor 208 can then interpret the code and instruct other components of the toy (e.g., the speaker) to respond accordingly. The bottom sensor 108 may be slightly elevated or raised over an underlying surface by the conductive touch elements or other pads. Alternatively, the bottom light sensor may be coplanar with a bottom surface of the toy and/or be placed flush against the underlying surface or electronic device.

The top sensor 106 is arranged to detect the presence or absence of ambient light and/or motion. As a result, the waving of a physical object, the covering of the toy 102 and/or the illumination of the toy 102 may be detected by the top sensor 106 and trigger a reaction from the toy 102. In various embodiments, the toy 102 is arranged to distinguish between different types of motions and actions e.g., it may generate a different reaction depending on the length of time that the toy is covered or how quickly an object is waved before it.

In response to any motion or light detected by the sensors, the speaker 112 may emit sound. The sound may be an audible sound that is played for the entertainment of a user (e.g., music or a voice.) Alternatively or in addition, the sound may be inaudible to the human ear (e.g., subsonic or ultrasonic). Such inaudible sounds can be used to transmit instructions to the electronic device 104 or another component. In various embodiments, the toy 102 also includes a microphone 211. The microphone 211 is arranged to detect audio signals, which the toy 102 can interpret as commands or instructions to perform particular responses (e.g., emit or sound, generate vibration or movement, etc.)

The storage device 210 may be any suitable device or hardware that is capable of storing a computer readable medium. The storage device 210 contains instructions for performing any of the operations described in this application for the toy 102. The processor 208 executes the instructions in the storage device 210. The processor 208 also analyzes signals received from the top sensor 106 or bottom sensor 108 and determines what action, if any, should be undertaken in response to the signals. The power supply 206 provides electricity to the storage device 210, processor 208, conductive elements 110, speaker 112 and sensors. A circuit (not shown) connects the various components with one another.

The toy 102 may have a wide variety of additional components. In some implementations, for example, the toy 102 includes a vibration mechanism that is arranged to shake or vibrate the toy 102. In still other embodiments, the toy 102 includes one or more lights. Some designs involve a toy 102 that flashes or emits light and/or vibrates in response to motion, audio or light-based control signals.

The toy 102 may come in a wide variety of shapes and sizes. In some embodiments, for example, the toy resembles a creature, alien, animal, human or human-like character or figure. The toy 102 may be a structure or figure that is substantially smaller than the underlying electronic device or platform, such that more than one such toy may be arranged together upon the surface of the electronic device at the same time, thereby triggering different responses from the device then when they are each placed individually on the device. In some designs, the toy 102 lacks any antenna and/or video screen. The outer surface of the toy may be covered in any suitable material, including plastic, cloth, hair, fur, etc.

Figure 3:
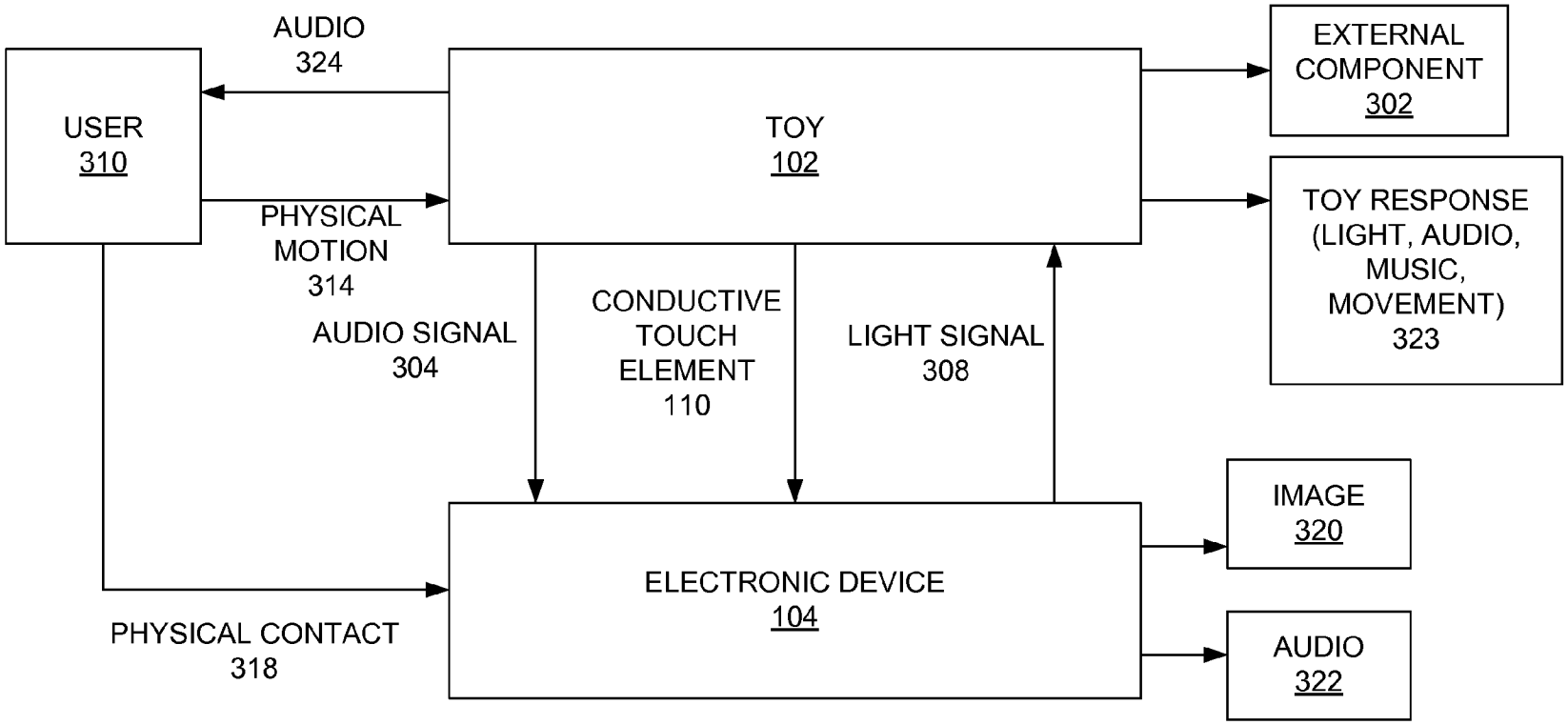
FIG. 3 is a block diagram illustrating a communication system for the toy and the electronic device according to a particular embodiment of the present invention.

Referring next to FIG. 3, a block diagram illustrating communication between the electronic device 104 and the toy 102 according to a particular embodiment of the present invention will be described. The block diagram includes the toy 102, the electronic device 104, a user 310 and an external component 302, which can all communicate with one another in a wide variety of ways.

In this example, there are three mechanisms for communication between the toy and the electronic device. The three mechanisms involve an audio signal 304, conductive touch element 110 and a light-based signal 308. That is, the toy 102 can communicate instructions to the electronic device 104 using the audio signal 304 that is emitted from its speaker 112. In some embodiments, this audio signal is also or instead received by an additional toy or other external component. The toy 102 can further communicate with the electronic device 104 using the conductive touch elements 110. The electronic device 102 can send light-based control signals 308 to the electronic device 104 e.g., by flashing a portion of screen that underlies the toy. Any of these communication mechanisms may be used simultaneously to exchange data and control instructions between the electronic device and the toy. An audio signal 304 from the toy 102 may be used to respond to a light signal 308 from the electronic device 104, and vice versa.

A user 310 can interact with both the toy 102 and the electronic device 104. For example, the user 310 can make a physical motion 314 that is detected by another sensor (e.g., a motion/ambient light sensor such as sensor 106 of FIG. 2) on the toy 102. The toy 102 may respond with audio 312 (e.g., a voice recording, a sound or music.) Additionally, the user 310 may touch a button or come in physical contact 318 with a touch-sensitive screen of the electronic device 104.

In response to any and all of the above inputs and interactions, the toy 102 and electronic device 104 may perform various operations (i.e., toy response 323). For example, the toy 102 may emit audible sounds, like a musical tune or a voice recording. In some embodiments, the toy may respond with light (e.g., flashing lights) and/or physical movement (e.g., vibration). The electronic device 104 may display one or more images 320 on its screen or generate corresponding audio 322.

There are numerous ways in which the above communication methods can be used to create a more engaging and interactive experience for a user. Consider an example in which a user is playing with the toy 102 and the electronic device 104. Initially, the toy 102 is placed on a particular region of the screen. The toy 102 sends out an inaudible audio signal 304, which is received by a microphone on the electronic device 104. Because of the audio signal 304, the electronic device 104 recognizes the toy as the Alien Musician, a particular character that will generate a unique set of responses, voice types and music from the electronic device 104 and the toy 102.

A game begins in which the user must quickly touch various images 320 that appear that on the touch-sensitive screen of the electronic device 104. During the game and based on the user's timing and/or accuracy in pressing the correct images, the electronic device 104 generates additional images 320 and words on its screen (e.g., "Good job!," "Bonus round!") The interactions with the electronic device 104 cause the device to send light-based control signals 308 to the toy 102, which cause the toy to utter audio 324 (e.g., music, verbal taunts, words of encouragement, etc.)

The game may also prompt the user 310 to make a physical motion 314 that is sensed by a top sensor 106 on the toy 102. The failure or success of the user to accomplish this task can be conveyed via an audio signal 304 sent from the toy 102 to the electronic device 104. The electronic device 104 and/or the toy 102 can then emit audio 322 or images 320 to praise or signal disappointment in the user as appropriate.

In some versions of the game, the electronic device 104 will light up a region of the screen that indicates the user that the user should physically pick up the toy 102 and move it to the lit up region. For a limited time period, the region may flash light signals 308 that query for the presence of the toy. If the user 310 moves the toy 102 to the region within the designated time period, the light sensor 108 at the bottom of the toy 102 will receive the flashing light signals 308. The toy 102 will then emit a suitable sound in response (e.g., victory music or a "Good job!") and also emits an inaudible sound (i.e., audio signal 304) to notify the electronic device 104 of this accomplishment. The electronic device 104 can then display additional graphics or emit additional sounds as a result (e.g., it can display a voice bubble pointing towards the toy location on the screen, saying "Terrific!", etc.) that indicate that the user 310 was successful.

The above example gives some sense of the new types of game mechanics that are made possible by the described technologies. Because of the bidirectional, full duplex communication system between the toy 102 and the electronic device 104, any action by one of the user 310, toy 102 or electronic device 104 can be immediately or concurrently communicated to the other components. If the toy 102 was limited to only one type of communication mechanism, the above level of interaction could not be possible. That is, if the toy 102 could only transmit audio signals, then the toy could never respond to interactions between the user and the electronic device 104 or respond to queries from the electronic device. If the toy 102 could only receive light signals, then the electronic device 104 would not be able to identify the unique properties of the toy and customize its graphics and sounds accordingly. If the toy 102 only detected changes in ambient light or motion, then interactions between a user and the toy 102 could not be effectively communicated to the electronic device 104. Of course, it should be appreciated that the above example is only one implementation of the present invention, and that a wide variety of different games, responses and interactions are possible.

Figure 4:
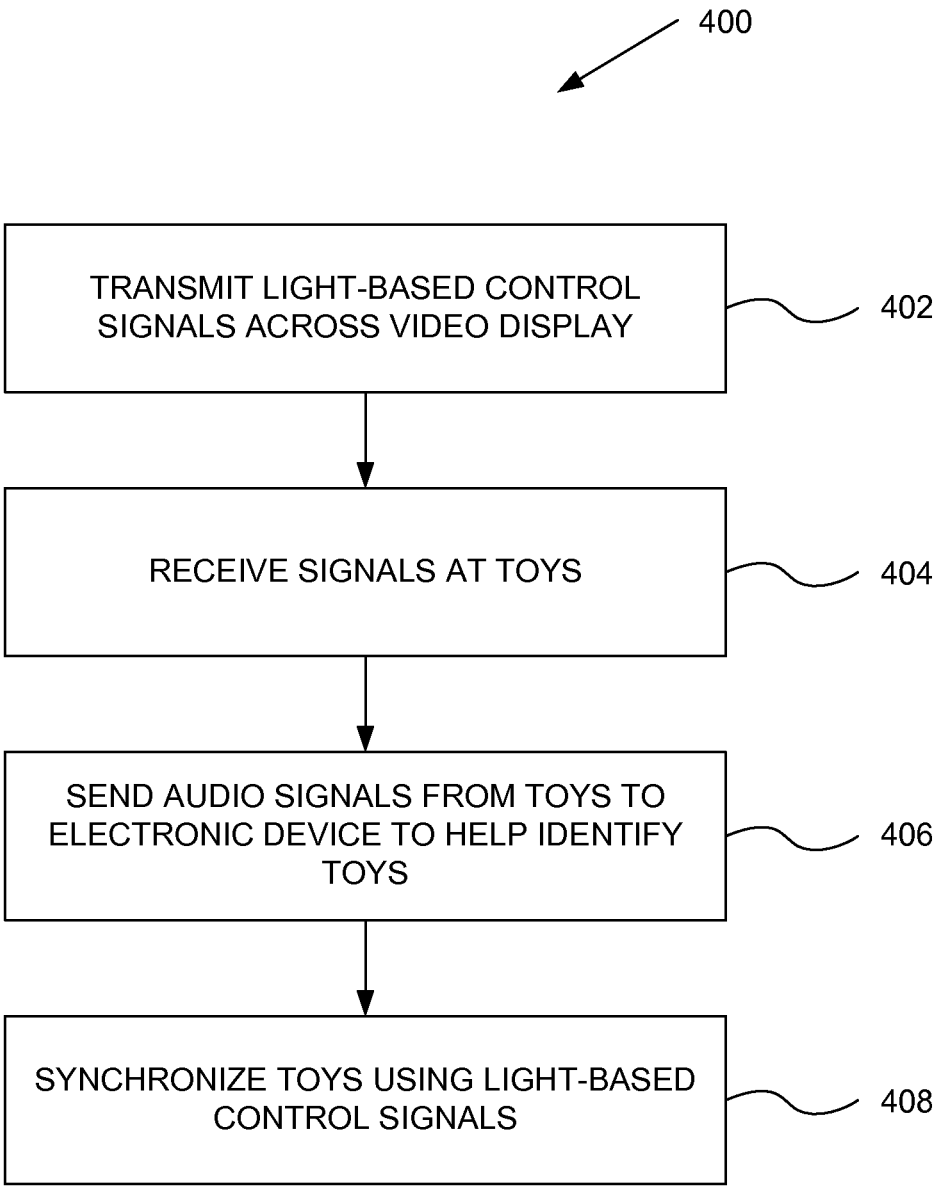
FIG. 4 is a flow diagram illustrating an example method for detecting and synchronizing multiple toys that are interacting with an electronic device.
Figure 5:
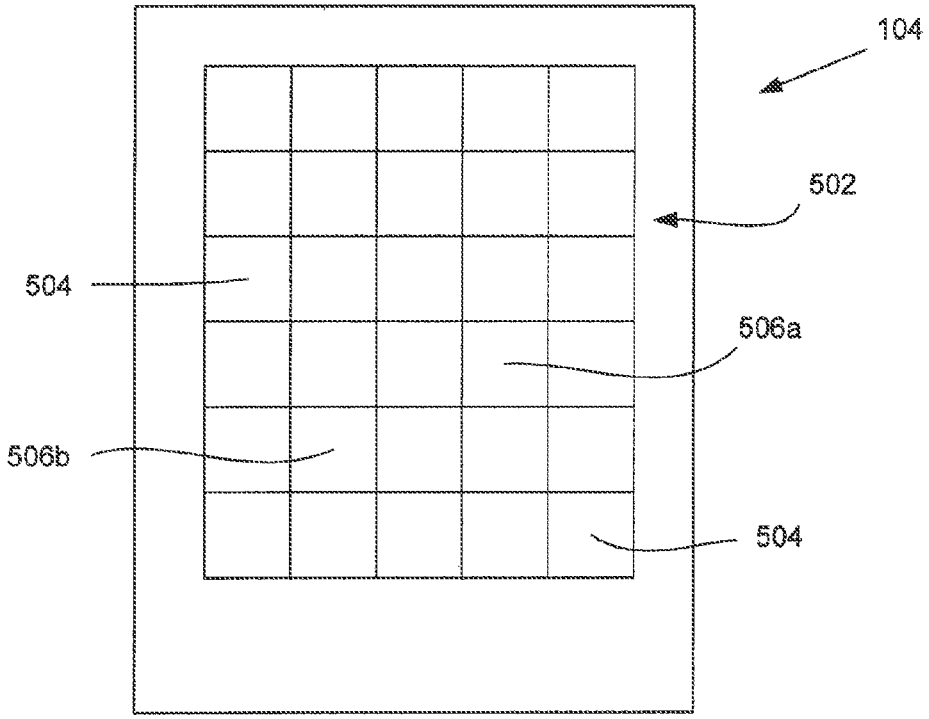
FIG. 5 is a diagram of an example electronic device with a screen divided into multiple locations that are flashed at different times to detect the presence of a toy.

Referring next to FIGS. 4 and 5, a method 400 for locating and synchronizing multiple toys on an electronic device according to a particular embodiment of the present invention will be described. Initially, at step 402, light-based control signals 308 are transmitted across a video display 502. FIG. 5 illustrates a video display screen 502 on an electronic device 104 (e.g., electronic device 104 of FIG. 1A or 3) that has been divided into multiple locations 504. In one embodiment, each of the locations is flashed to generate a code. The code is arranged to query for a presence of a toy.

Although only a few locations 504 are shown in the illustration, there may be many more e.g., hundreds of discrete locations 504 that cover all or at least the majority of the screen 502. In various embodiments, each location 504 is flashed in sequence, one after the other. This process can be completed for all the locations 504 on the screen 502 very quickly. In some designs, the flashing of all the locations of the video screen is performed in less than one, two or three seconds.

In the illustrated example, two toys, a first toy and a second toy (e.g., each identical or similar to toy 102 of FIGS. 1A, 2 and 3), have been positioned at first toy location 506*a* and second toy location 506*b* on the video display screen. When the flashing reaches those locations, the toys receive the light-based control signals 308 (step 404). In response, the toys each emit an audio signal 304 that is detected by a microphone of the electronic device 104 (step 406). Typically, this audio signal 304 is inaudible to the human ear (e.g., ultrasonic or subsonic) and helps identify the toy to the electronic device 104. For example, if the toys represent two distinct characters, Alien Musician and Alien Rock Star, then the audio signals 304 help the electronic device 104 to identify them as such. As a result, the electronic device 104 later generates graphics and/or sounds that are tailored to those specific characters.

Based on the audio signals 304, the electronic device 104 then synchronizes the first and second toys (step 408). The toys may be synchronized in a wide variety of ways. For example, the electronic device 104, the toys and a user may communicate with other in any manner described in connection with FIG. 3 or any of the other figures. During the course of this communication, the first and second toys will emit distinct, inaudible audio signals 304 that are to be received by the electronic device 104. Various embodiments involve the electronic device coordinating the toys so that their audio signals 304 do not overlap or interfere with one another. In some designs, for example, the electronic device 104 sends light-based control signals 308 to the toys by flashing suitable light sequences at their respective toy locations 506*a*/506*b*. These are detected by the bottom light sensors 106 in the toys. The light-based control signals 308 are arranged to help control the timing of the sending of the audio signals 304 by the toys so that they are sent sequentially or at different times, rather than simultaneously. As a result, the electronic device 104 can more clearly and reliably detect discrete audio signals from each toy using its microphone.

Another way in which the electronic device 104 can synchronize the toys is in the production of audible sounds, such as music or voice. In various embodiments, for example, the electronic device 104 flashes instructions (i.e., using light-based control signals 308) to each toy so that one emits speech, then the other, thereby simulating a back-and-forth conversation in which the speech of one toy does not overlap with the speech of the other. Alternatively, the electronic device can send light-based control signals instructing the toys to play audible music. The playing of music is coordinated so that the music generated by one toy is in time with the music generated by the other toy. For example, one toy could generate music indicating that it is playing one type of instrument, the other toy could generate music indicating that it is playing another kind of instrument, and the music of the two toys could be coordinated and synchronized to convey the idea that they are playing a duet.

Figure 6:
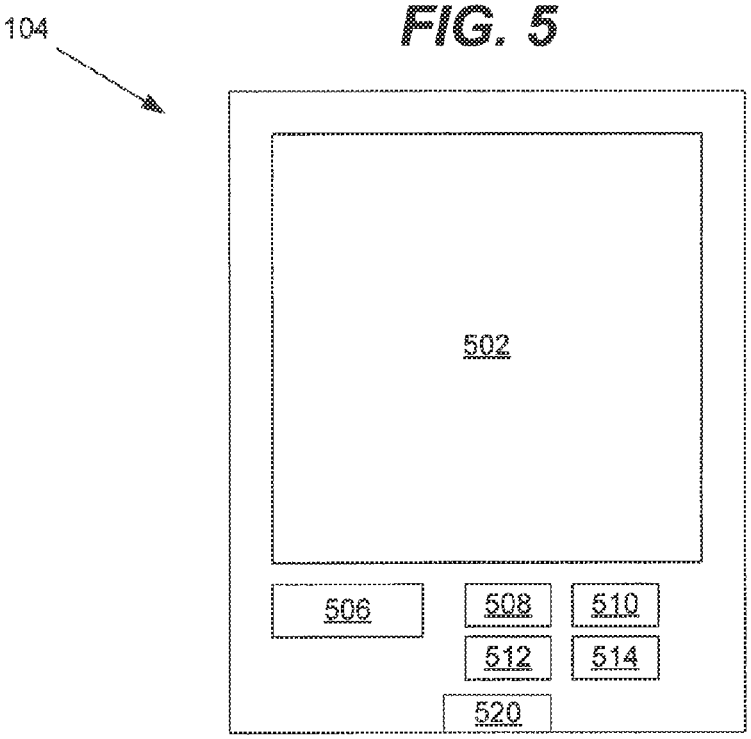
FIG. 6 is a diagram of an electronic device according to a particular embodiment of the present invention.

Referring next to FIG. 6, an electronic device 104 according to a particular embodiment of the present invention will be described. The electronic device 104 includes a microphone 520, a video screen 502, a storage device 506, a processor 508, a power supply 510, a storage device 514 and a speaker 512. In various embodiments, the illustrated electronic device may be understood to be any of the electronic devices 104 described in the figures of the application. In the illustrated embodiment, the electronic device 104 is a tablet computer, although in other embodiments the electronic device 104 may also be any suitable computing device, toy platform or stage.

The microphone 520 is arranged to detect audio signals 304 (e.g, subsonic or ultrasonic) that are emitted from the toy. The signals are received at the processor 508, which is arranged to control other components of the electronic device 104 so that they respond accordingly. These components include the speaker 512, which is arranged to emit sounds such as voice or music, and the video screen 502.

The video screen 502 is arranged to display images and/or transmit light-based control signals 308 to a toy that is overlying a portion of the screen. The light-based control signals 308 may be transmitted by flashing a portion of the screen to form a code that can be detected by a suitable light sensor in a toy. In some implementations, the video screen 502 is a video display screen, a capacitive screen and/or a touch-sensitive screen. In other embodiments, the video screen 502 is instead one or more light emitting locations that are non-touch sensitive and/or that are arranged to send the control signals. One such design involves a toy platform (e.g., a play stage for toy rock band members.) The toy platform, rather than being a full-fledged tablet computer, instead is a simpler device that includes one or more light emitting locations where toys can be placed so that the toys and the platform can communicate with one another.

Various embodiments of the electronic device include a storage device 514, which may be a hard drive, solid state drive or other device that is capable of storing a computer readable medium. The storage device 514 contains instructions for performing any of the operations described in this application in connection with the electronic device 104. The processor 508 is arranged to receive input from the other components (e.g., the microphone 520, the video screen 502, etc.) and execute the instructions based on the input. The power supply 510 is coupled with and provides electricity to all of the above components in the electronic device 104. A circuit (not shown) connects the various components and enables them to communicate with one another as appropriate.

Although only a few embodiments of the invention have been described in detail, it should be appreciated that the invention may be implemented in many other forms without departing from the spirit or scope of the invention. The electronic device 104 and toy 102 are sometimes described with different features in the context of different figures. However, it should be appreciated that any of the features of the toy 102 and electronic device 104 described in connection with one figure can be integrated into the corresponding toy and electronic device of any other figure. Although the devices (e.g., the electronic device, the toy, etc.) are described with various features, not all implementations of those devices need to have the same feature set. For example, the present invention contemplates toys that both have and lack conductive touch elements and/or ambient light/motion sensors. The figures and description refer to a toy 102 and an electronic device 104 with various components and that each are arranged to perform particular operations. It should be understood that the toy 102 may be arranged to perform any operation or have any feature or component that is described in connection with the electronic device 104, and vice versa. For example, the toy 102 and/or the electronic device 104 can have and use a light sensor for receiving light signals, a microphone for receiving audio signals and a speaker for transmitting audio signals. In various implementations, the toy and/or the electronic device include additional components, such as a vibration mechanism that is arranged to generate physical vibration or shaking, one or more lights that are configured to glow or flash, etc. Therefore, the present embodiments should be considered illustrative and not restrictive and the invention is not to be limited to the details given herein.

What is claimed is:

1. A method for a toy set that includes an electronic device and a toy wherein the electronic device communicates with the toy using a light-based control signal and the toy communicates with the electronic device using an audio signal, the method comprising:

generating a light at a surface of an electronic device wherein the light forms a control signal;

receiving the light-based control signal at a light sensor of a toy that overlies the surface of the electronic device; and in response to the light-based control signal, generating an audio control signal from the toy;

receiving the audio control signal at a microphone of the electronic device;

detecting, using a sensor on the toy, a motion over the toy;

in response to the detection of the motion, emitting a second audio control signal from the toy;

receiving, at the electronic device, the second audio control signal from the toy; and in response to the receiving of the second audio control signal, performing an operation at the electronic device wherein the operation is at least one of 1) generating an audible sound; and 2) displaying an image on a display screen of the electronic device.

2. A method as recited in claim 1 wherein:

the toy includes a base that rests over a portion of the electronic device; and the light sensor is situated at the base and faces the electronic device.

3. A method as recited in claim 1 wherein the electronic device includes a capacitive touch screen and wherein the capacitive touch screen transmits the light-based control signal to the light sensor of the toy.

4. A method as recited in claim 3 wherein the toy includes capacitive touch elements which allow the capacitive touch screen to identify the toy or the location of the toy on the screen.

5. A method as recited in claim 1 wherein the audio signal is one selected from the group consisting of inaudible, subsonic and ultrasonic.

6. A method as recited in claim 1 wherein:

the electronic device is one of 1) an electronic device with a display screen wherein the light is generated at the surface of the display screen; and 2) a toy playset wherein the light is generated at one or more locations on the toy playset.

7. A method as recited in claim 6 wherein:

the toy is one of a figurine and a toy vehicle.

8. A method as recited in claim 7 further comprising:

in response to the light-based control signal received from the electronic device, the toy performs an operation that is one of 1) playing music; 2) playing a voice recording; 3) generating an audible sound; 4) physically moving; and 5) generating light using a light source on the toy.

9. A method as recited in claim 1 wherein the electronic device includes a display screen, the method further comprising:

detecting, at the electronic device, that a user has touched the surface of the display screen;

generating the light at the surface of the display screen of the electronic device in response to the detection of the touching, thereby forming the light-based control signal; and receiving the light-based control signal at the light sensor of the toy wherein the light-based control signal indicates to the toy that the user has touched the surface of the display screen.

10. A method as recited in claim 1 wherein the toy is a first toy and the light-based control signal is the first light-based control signal, the method further comprising:

providing a second toy that overlies the surface of the electronic device, the second toy including a light sensor arranged to receive light-based control signals from the electronic device;

generating light at the surface of the electronic device to generate the first light-based control signal and a second light-based control signal; and emitting audio signals from the first toy and the second toy in response to the first and second light-based control signals, respectively, wherein the electronic device uses the first and second light-based control signals to help synchronize the operation of the first and second toys such that the audio signals emitted from the first toy and the second toy in response to the first and second light-based control signals do not interfere with one another.

11. A method as recited in claim 1 further comprising:

generating light at a plurality of different times at a plurality of different locations, respectively, on the surface of a display screen of the electronic device to determine whether a toy is on the display screen wherein the toy overlies one of the locations and wherein the plurality of locations collectively cover substantially the entire display screen;

when light is generated at the one of the locations that underlies the toy, generating the audio control signal from the toy; and using, at the electronic device, the audio control signal received from the toy to help identify the toy.

12. A toy that is capable of two way communication with an underlying electronic device using audio and light signals, the toy comprising:

a speaker that is arranged to emit an audio control signal to be received by the electronic device;

a light sensor that is arranged to receive a light-based control signal from the electronic device;

a sensor for detecting motion over the toy; and a power supply that is coupled with and provides electrical power to the speaker and the light sensor;

wherein in response to the light-based control signal the toy emits the audio control signal; and wherein in response to detection of motion, the toy emits a second audio control signal which is received by the electronic device and causes the electronic device to perform an operation including at least one of 1) an audible sound; and 2) an image on a display screen of the electronic device.

13. A toy as recited in claim 12 wherein the toy includes a base that is arranged to rest on the electronic device wherein the light sensor is situated in the base and is arranged to face towards the electronic device.

14. A toy as recited in claim 12 wherein the light sensor is arranged to receive a flashing light sequence from the electronic device and wherein the toy is arranged to interpret the flashing sequence as instructions for the toy.

15. A toy as recited in claim 12 wherein the audio control signal emitted by the speaker is one selected from the group consisting of inaudible, subsonic and ultrasonic.

16. A toy as recited in claim 12 wherein the toy is arranged to emit the audio control signal in response to receiving the light-based control signal through the light sensor.

17. A toy as recited in claim 12, further comprising a sensor that is arranged to detect a motion of an object over the toy.

18. A toy as recited in claim 12, further comprising one or more conductive touch elements that are arranged to help physically support the toy when the toy is positioned on a display screen of the electronic device wherein the conductive touch elements are arranged such that the electronic device uses the conductive touch elements to identify the toy when the toy is placed on the display screen of the electronic device.

19. A toy as recited in claim 12 wherein the toy is one of a figurine and a toy vehicle.

20. A toy as recited in claim 19 wherein the toy is arranged to perform an operation in response to the light-based control signal wherein the operation is one of 1) playing music; 2) playing a voice recording; 3) generating an audible sound; 4) physically moving; and 5) generating light using a light source on the toy.

21. A computer readable non-transitory storage medium that includes executable computer code embodied in a tangible form wherein the computer readable storage medium includes:

executable computer code operable to generate a light at a surface of an electronic device wherein the light forms a control signal;

executable computer code operable to receive the light-based control signal at a light sensor of a toy that overlies the surface of the electronic device;

executable computer code operable to generate an audio control signal from the toy in response to the light-based control signal;

executable computer code operable to receive the audio control signal at a microphone of the electronic device;

executable computer code operable to detect motion from a sensor on the toy, and in response to the detected motion, emit a second audio control signal from the toy to be received by the electronic device; and executable computer code operable to perform an operation at the electronic device in response to receiving the second audio control signal, wherein the operation is at least one of 1) generating an audible sound; and 2) displaying an image on a display screen of the electronic device.

* * * * *